US006374718B1

(12) United States Patent
Rescigno et al.

(10) Patent No.: US 6,374,718 B1
(45) Date of Patent: Apr. 23, 2002

(54) SILENCER FOR SHOTGUNS AND A METHOD OF MAKING THE SAME

(75) Inventors: Michael Rescigno; Philip Lebow, both of Los Angeles, CA (US)

(73) Assignee: Tactical Operations Inc., Los Angeles, CA (US)

( * ) Notice: Subject to any disclaimer, the term of this patent is extended or adjusted under 35 U.S.C. 154(b) by 0 days.

(21) Appl. No.: 09/616,966

(22) Filed: Jul. 14, 2000

(51) Int. Cl.[7] ..... F41A 21/00
(52) U.S. Cl. ..... 89/14.4
(58) Field of Search ..... 89/14.2, 14.3, 89/14.4, 14.6; 181/223

(56) References Cited

U.S. PATENT DOCUMENTS

| | | | | | |
|---|---|---|---|---|---|
| 1,017,003 | A | * | 2/1912 | Kenney | 417/364 |
| 1,111,202 | A | * | 9/1914 | Westfall | 89/14.4 |
| 2,829,742 | A | * | 4/1958 | Wallace | 52/655.1 |
| 3,748,956 | A | * | 7/1973 | Hubner | 89/14.4 |
| 4,291,610 | A | * | 9/1981 | Waiser | 89/14.4 |
| 4,576,083 | A | | 3/1986 | Seberger et al. | |
| 4,588,043 | A | | 5/1986 | Finn | |
| 4,869,151 | A | * | 9/1989 | Chahin | 89/14.3 |
| 4,928,573 | A | | 5/1990 | Fansler et al. | |
| 4,974,489 | A | | 12/1990 | Fishbaugh | |
| 5,078,043 | A | | 1/1992 | Stephens | |
| 5,136,923 | A | | 8/1992 | Walsh, Jr. | |
| 5,164,535 | A | | 11/1992 | Leasure | |
| 5,315,914 | A | | 5/1994 | Schumacher | |
| 5,355,765 | A | * | 10/1994 | Rogers | 89/14.4 |
| 5,415,073 | A | * | 5/1995 | Ciluffo | 89/14.3 |
| 5,679,916 | A | * | 10/1997 | Weichert | 89/14.4 |
| 5,883,328 | A | | 3/1999 | A'Costa | |

* cited by examiner

*Primary Examiner*—Charles T. Jordan
*Assistant Examiner*—Jordan Lofdahl
(74) *Attorney, Agent, or Firm*—Blank Rome Comisky & McCauley LLP

(57) ABSTRACT

A silencer for a shotgun firearm comprises a metal body tube, a front end closure having a projectile exit guide, and a rear end closure having a barrel mounting element. A plurality of conical baffles with metal guide bushings are serially positioned in the body and arranged coaxially with the bore of the shotgun barrel. The guides are spaced apart a distance less than the axial length of the shot cup of the shotgun projectile. An expansion chamber is provided in the body rearwardly of the muzzle where the muzzle gasses are initially discharged into the body.

17 Claims, 1 Drawing Sheet

SILENCER FOR SHOTGUNS AND A METHOD OF MAKING THE SAME

FIELD OF THE INVENTION

The present invention relates to a sound suppressor and flash attenuator for shotguns and to a method of making the same.

BACKGROUND OF THE INVENTION

Silencers for firearms are well known in the art and are typically designed for use with rifles and pistols. Heretofore, many different designs have been proposed and manufactured for firearms that use single projectiles, that is, conventional one-piece bullets, the discharge velocities of which are either supersonic or subsonic. Supersonic projectiles typically require silencers with expansion chambers serially disposed inside a gas tight housing along the path of travel of the bullet beyond the firearm muzzle to contain and allow expansion of the gaseous propellant charge and thereby reduce the expansion noise and often the visible flash from the burning propellant. Such expansion chambers usually include baffles arranged more or less transversely to the firearm bore, the spaces between them providing the required expansion chamber volumes.

The central bore of the silencer provided for passage of the projectile is somewhat larger than the projectile diameter to avoid damage to the silencer in the event of a deflection in the path of the projectile. Typically, the tighter the clearance between the silencer bore and the projectile diameter, the greater the noise attenuation achieved. However, attenuation must be balanced against manufacturing tolerances of the silencer, to avoid internal collisions with the projectile discharged from the muzzle.

Ported barrel silencer designs perform better where gasses and projectile velocities are near or below the speed of sound and total gas volumes are relatively low. These designs frequently depend on turbulence chambers and different density damping materials to enhance turbulence. Such designs are well proven, especially in small caliber firearms. These designs normally comprise a jacket tube and inner dividers composed of screen mesh, sometimes attached by a screw thread fitting, or integrally formed with a ported barrel of reduced outer diameter, with layers of screen mesh rolled around the ported section. Many of the designs use compliant, washer-like "wipers" which have a central hole for passage of the projectile that has a smaller diameter than the actual diameter of the projectile. See, for example, U.S. Pat. No. 4,974,489. This arrangement provides momentary gas sealing during the passage of the projectile through the series of wipers and chambers. While such designs are effective silencer/suppressors, the combination of the rigid projectile and hot gasses wearing on the compliant wipers results in a relatively short life of the silencer components. Replacement is required, in some cases, in a few as thirty firings.

In most designs of silencers/suppressors, the solid projectile is driven through or past chambers or compliant wipers, and gasses are stripped away and delayed by various mechanisms. Examples of such silencers/suppressors are disclosed in U.S. Pat. Nos. 1,482,805; 4,576,083; 4,588,043; 4,928,573; 5,078,043; 5,136,923; and 5,164,535.

Shotguns have never been easily quieted, due to the problem of the multipart projectiles composed of wads, cards, disks, and loose shot separating in the silencer body, in designs where the projectile flies free. The standard solution for shotgun silencing has been to utilize a ported barrel to contain the shot column and surround the barrel with a layer of material to cause turbulence in the trapped gasses, and delay their release back into the barrel after discharge of the projectile. Shotguns deliver their projectiles and gasses at supersonic speeds. Therefore, silencer designs more suited for sonic and subsonic projectiles are not particularly successful when used on shotguns. Nor are baffle-type silencer designs suitable for shotguns. Lack of safe containment of the shot and wad mass flying freely in the baffle section precludes close clearances. With greater projectile to baffle clearance, attenuation is very poor. U.S. Pat. No. 5,315,914 describes some of the problems associated with shotgun silencing and discloses one prior art solution to shotgun silencing.

It would be desirable to employ techniques for silencing shotguns that are consistent with existing technology for silencing single projectile firearms. The adoption of new shotgun ammunition technology makes possible the silencer/suppressor of the present invention.

SUMMARY OF THE INVENTION

The present silencer/suppressor invention has been specifically designed to attenuate the flash and blast of a shotgun firearm. An additional benefit of the invention is recoil reduction owing to the large interior surface area against which the muzzle gasses act in the forward direction.

The circumstance that makes possible the effectiveness of the present invention is the nearly universal adoption by modem shotgun ammunition manufacturers of a high-density polyethylene shot cup and wad assembly. The shot cup of such ammunition is designed to contain the shot during its passage down the bore of the barrel and to cushion the shot against deformation because of contact with the barrel wall. To effect easier loading, the filler wads and overpowder gas seal are made integral with the shot cup. In some designs, the shot holding cup portion of the wad assembly is slit longitudinally so as to open in a petal-like manner upon exit of the wad assembly from the shotgun muzzle. Therefore, until the wad assembly/projectile exits from the muzzle, it exists as a compliant, somewhat elongated projectile.

Some typical examples of shotgun ammunition that are suitable for use with the silencer/suppressor of the present invention include: Federal 12 ga shells loaded with the "12s" series plastic wads and Federal sabotted slugs; Remington 12 ga shot shells loaded with the "Power Piston" wad and Remington sabotted slugs; Winchester shot shells using the WAA12F114 heavy load wad; Brenneke 12 ga slugs with attached wad; any specialty 12 ga shot shells with unitized wads loaded by Choke Mfg.; handloaded specialty 12 ga shells loaded with unitized wads known as "LBC" or "Ranger Plus" from Ballistic Products Inc.; and specialty police door-breaching shot shells with powdered metal frangible slugs. It should be understood that the foregoing listing of suitable shotgun ammunition does not include all presently available shotgun ammunition that will function properly with the silencer/suppressor of the present invention. In addition, of course, newly developed shotgun ammunition may also be suitable for use with the silencer/suppressor of the present invention.

The present invention takes advantage of the foregoing features of modem shotgun ammunition in the following manner. First, the compliant nature of the wad assembly/projectile permits the use of non-compliant or non-resilient wad guides or wipes along the projectile bore, without the need for clearance beyond the bore diameter of the shotgun barrel itself. This is the converse of the conventional compliant seal or wipe and rigid projectile combination for gas sealing during projectile passage through a silencer that has been used in many previous designs.

Secondly, by spacing the guides and their mounting baffles close enough to one another in the axial direction, the need for a continuous barrel through the baffles is eliminated allowing the use of a silencer design more suited to the supersonic nature of a shotgun discharge. The wad assembly spans at least two guides at all times, and engages three guides for most of its travel through the silencer baffles. This arrangement provides excellent sealing and maintains the wad assembly in a closed, single-projectile-like condition. Accordingly, the attenuation level for the silencer of the present invention is very high and is comparable to that of the better silencers available for single projectile firearms.

Thirdly, because the traveling compliant seal formed by the wad assembly is replaced with every shot, the interior components of the silencer of the present invention have a long life when compared with conventional sealing wiper designs. Maintenance is simplified to rinsing out carbon and errant power grains from the silencer interior. The use of a lubricating coolant or coupling fluid also reduces wear of the guide bores or wipes from passage of the projectile.

Previous baffle cone silencer designs have been expensive because of the high cost of the stamping dies necessary for manufacturing the inner partitions. Other prior art designs use complicated machined parts with complex angle cuts and close tolerances. The present invention has been simplified and optimized for inexpensive manufacture on screw machines, robotic lathes and high volume computer-controlled machines. Stock material sizes can be utilized for all components.

With the foregoing and other objectives, features and advantages of the invention that will become hereinafter apparent, the invention may be more clearly understood by reference to the following detailed description of the invention, the appended claims and the several views illustrated in the drawings attached hereto.

DETAILED DESCRIPTION OF THE INVENTION

Figure 1:
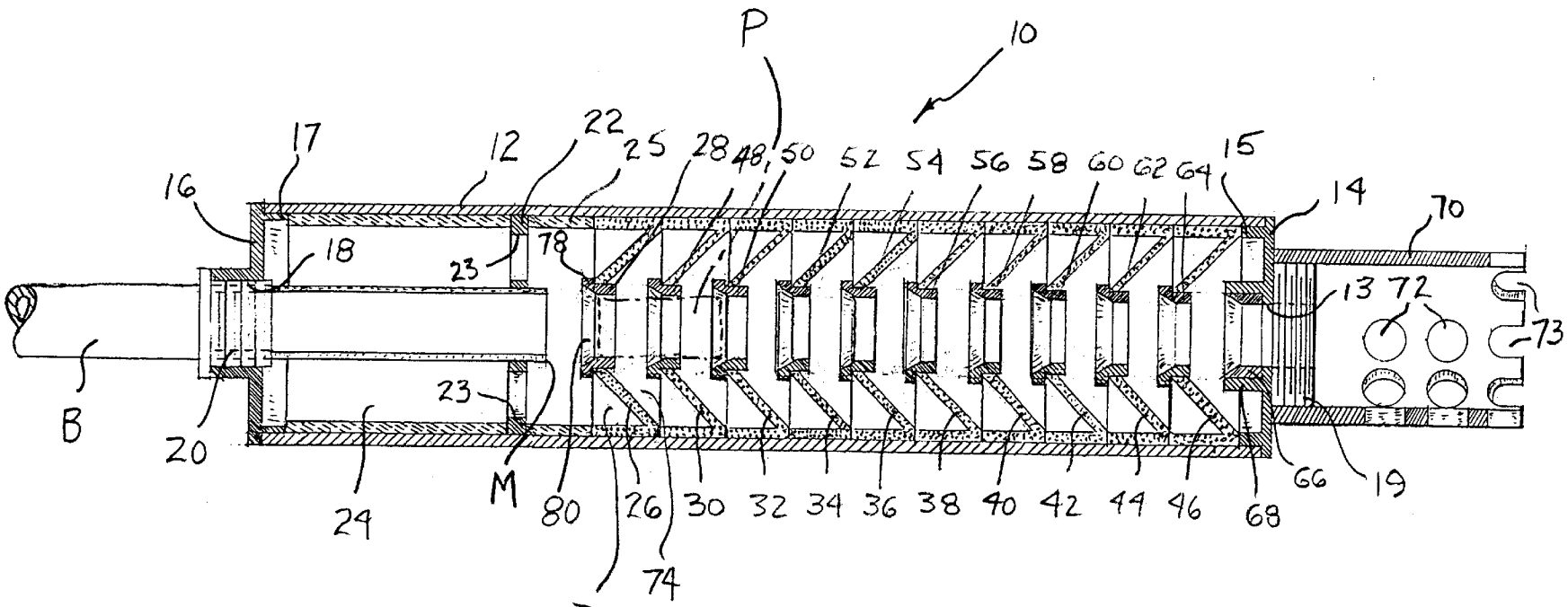
FIG. 1 is a cross-sectional view of an embodiment of the shotgun silencer/suppressor of the present invention.

Referring to FIG. 1, there is shown a shotgun silencer/suppressor according to the invention which is designated generally by reference numeral 10, hereinafter referred to simply as silencer 10. The silencer 10 comprises a cylindrical body tube 12 having front end closure or cap 14 and rear end closure or cap 16. The silencer 10 is of generally robust construction, the body 12 being mill graded 1/8 inch wall stainless steel tubing, or equivalent aluminum tubing. The front and rear end closures 14, 16 are made of bar stock from the same material as the body tube, and are preferably welded to the body. Preferably, the front and rear end caps 14, 16 are provided with annular concentric flanges or rims 15, 17 over which the silencer body 12 is fitted and centered.

The front end closure 14 has a central bore 13 with an externally threaded fitting 19 on the forward face of the closure. The rear end closure 16 is provided with an internally threaded central bore 18 for screw thread mounting to a threaded adaptor 20 affixed to the barrel B of a shotgun (not shown). Alternatively, the rear end closure 16 may be provided with a flange to facilitate welding the silencer to the shotgun barrel B. The rear body closure 16 centers the silencer body 12 over the shotgun barrel B. The silencer 10 extends rearwardly over the barrel B to the screw thread mounting adaptor 20 or to the location where the rear closure is to be permanently affixed to the barrel. Centering of the silencer body relative to the barrel B is further accomplished by one or more support disks 22 (only one shown) that extends from the inside wall of the body tube 12 radially inwardly to the outside diameter of the barrel B, immediately axially rearwardly of the point where the muzzle M discharges. The support disk 22 is provided with a plurality of holes 23.

This arrangement of the support disk 22 with holes 23 and a cylindrical spacer provides a primary expansion chamber 24 for propellant gasses which surrounds approximately the last four inches of the shotgun barrel B between the rear end closure 16 and the support disk 22. Advantageously, this construction provides a substantial volume for the primary expansion chamber 24 without unduly extending the silencer 10 beyond the muzzle M of the shotgun.

Immediately forward of the muzzle M of the shotgun barrel is a first conical baffle 26 which is spaced from the muzzle M and support disk 22 by a cylindrical spacer 25. Guide bushing 28 is spaced approximately 0.375 inch away from the muzzle M and is held coaxially with the bore of barrel B by baffle 26. A plurality of additional baffles 30, 32, 34, 36, 38, 40, 42, 44, 46 and bushings 48, 50, 52, 54, 56, 58, 60, 62, 64 are serially located in a coaxial arrangement between baffle 26 and bushing 28 and front end closure 14. A final bushing 66 is located in an annular rim 68 formed integrally with front end closure 14 and concentrically to the central bore 13. Each bushing is spaced approximately 0.375 inch away from the next adjacent bushing and the inside diameter of the guide bushings is substantially the same as the inside diameter of the barrel B of the shotgun.

On the forward face of the front body closure 14 threaded to fitting 19 is a tube 70 with openings or perforations 72 in the sidewall thereof and crenellations 73 cut into the forward end thereof. Perforated tube 70 forms a "standoff" for use with police door breaching cartridges and allows muzzle gasses to vent from the interior of the tube without overstressing the silencer body construction, such as may occur if the silencer 10 were pressed against a solid object with no escape path for the gasses.

Referring now to the baffle 26 as representative of all the baffles, the baffle components are preferably fabricated from aluminum with a minimum thickness of ⅛ inch sections. The baffles may also be made of composite plastic materials. Suitable composite plastics include thermosetting resins, e.g., phenolics, or thermosetting epoxy-amine resins with carbon fiber mat reinforcement (carbon-phenolic or carbon-epoxy), or carbon strand reinforced high density polyethylene. Other composite plastic materials may be suitable as will be evident to those skilled in the art.

Each baffle comprises a conical portion 74 formed integrally with a cylindrical portion 76 by casting, welding or any other suitable manufacturing process. Referring now to the bushing 28 as representative of all the bushings, the bushing components are preferably fabricated from stainless steel and are provided with a flange or shoulder 78 which retains the bushings in place when they are press-fitted or adhesively bonded into the baffles and prevents the bushings from being driven through the baffle by the force of the projectile and propellant. Each bushing has a conical portion 80 facing rearwardly toward the muzzle M for guiding the shot cup of the shotgun projectile and maintaining the shot cup in its cylindrical condition until it passes out the bore 13. Each set of adjacent baffles forms an additional expansion chamber for the propellant gasses so that a plurality of secondary expansion chambers (ten in the embodiment shown) further reduce noise and flash from the shot.

Although the conical shape of the baffles is preferred for the present invention, it is also possible to form the baffles in other shapes. For example, the conical portions of the baffles may be replaced by flat, concave or convex disks or toroidal elements without departing from the scope of the invention.

In one arrangement of the invention, the primary expansion chamber 24 is empty except for the ambient air or a vaporizable coupling fluid in the chamber. In order to optimize silencer performance, in a second arrangement, the primary expansion chamber 24 contains a conventional machined element (not shown) for increasing the turbulence of both the precursor and propellant gasses that expand into the chamber and for providing a larger conductive surface for impingement of hot propellant gasses. The use of such a turbulence enhancer is determined by the burn characteristics of the propellant powder of the individual brand of shotgun ammunition being used. Propellants providing higher temperatures at the muzzle, that is, with slower bum rates, require the use of the primary expansion chamber turbulence labyrinth for best attenuation. Lower temperature gasses resulting from faster burning propellants or heavier projectiles causing complete propellant combustion, require little or no additional turbulence for good attenuation.

The turbulence enhancer may be as simple as a series of perforated aluminum plates installed between the rear end closure 16 and the support disk 24 or as complex as a piece machined into a form with tangential slots propagating spirally around the outside diameter of the barrel B from the end of the muzzle M rearwardly to the rear end closure 16. All perform similarly to increase turbulence and function as a simple heat sink. Low density wire meshes will also perform the task, except that cleaning such meshes in a sealed unit is more difficult.

A shotgun projectile P is shown is dash-dot lines passing along the axis of the silencer 10 extending between bushings 28, 48 and 50. The projectile P is of a type having a compliant shot cup which retains its substantially cylindrical unitary form until the shot cup passes through bushing 66 and bore 13 at the front end closure 14 of the silencer 10 when it spreads into a petal-like form as described above.

A vaporizable coupling fluid in the primary expansion chamber and the aluminum interior construction also function as flash suppressors. The mechanism of cooling burning propellant particles and incandescent gasses occurs through heat conduction and the absorption of significant numbers of calories of heat out of the gasses through vaporization of the fluid. Quenching of flame and powder granules also occurs from simple contact with unvaporized fluid. The fluid may be an aqueous solution with conventional additives to enhance heat transfer to the interior metallic components of the silencer, lubricate the guide bushings, and quench burning ejecta from the barrel. Moreover, the water component of the aqueous fluid further cools the muzzle gasses through vaporization and expansion into steam. Suitable coupling fluids include, for example, a synthetic soluble oil cutting fluid with water, a wetting agent, such as Kodak Photo-Flow, and rust inhibitors. The high caloric absorption for vaporization results in effective gas cooling and the wetting of the baffles provides excellent heat transfer from the hot gasses.

Although certain presently preferred embodiments of the invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A shotgun silencer for a shotgun projectile having a compliant shot cup comprising;

a closed body having front and rear ends, an interior wall and a longitudinal axis;

a front end closure having a projectile exit guide bushing;

a rear end closure having a mounting element for mounting the body to the barrel of a shotgun having a muzzle disposed within the body; and a plurality of baffles arranged in the body coaxially with the muzzle and each other and being spaced axially along the longitudinal axis of the body, each baffle supporting a metal guide bushing, said guide bushings being spaced apart less than the length of the shot cup and having a diameter substantially the same as the inside diameter of the barrel of the shotgun.

2. A shotgun silencer as defined in claim 1, wherein said body extends rearwardly past the muzzle, a perforated support disk arranged between the interior wall of the body and the barrel of the shotgun adjacent the muzzle so as to form a primary expansion chamber extending coaxially from the muzzle to the rear end closure and surrounding the forward end of the barrel.

3. A shotgun silencer as defined in claim 1, wherein said guide bushings are made of stainless steel and said baffles are made of aluminum.

4. A shotgun silencer as defined in claim 1, wherein said baffles comprise a conical portion and a cylindrical portion integrally formed with one another, said cylindrical portion having a diameter substantially the same as the interior wall of the body.

5. A shotgun silencer as defined in claim 4, wherein the guide bushings are press-fitted into the conical portions, each guide bushing having a flange for retaining the guide bushing in the conical portion into which it is fitted.

6. A shotgun silencer as defined in claim 1, wherein said baffles are spaced apart to form a plurality of expansion chambers along said body.

7. A shotgun silencer as defined in claim 1, wherein the body and front and rear end closures are made of aluminum and are welded together.

8. A shotgun silencer as defined in claim 1, including a perforated standoff tube mounted to the front end closure, said tube having a forward edge with a plurality of crenellations therein.

9. A shotgun silencer as defined in claim 1, including an aqueous vaporizable fluid in the body.

10. A shotgun silencer as defined in claim 1, wherein the axial distance between the guide bushings at the ends of a series of three adjacent guide bushings is less than the length of the shot cup.

11. A shotgun silencer as defined in claim 1, wherein the body and front and rear end closures are made of stainless steel and are welded together.

12. A shotgun silencer as defined in claim 1, wherein a threaded adapter is mounted to the barrel of the shotgun rearwardly of the muzzle, the mounting element comprising a threaded bore in the rear end closure.

13. A shotgun silencer as defined in claim 2, wherein the primary expansion chamber has a length of about four inches.

14. A shotgun silencer as defined in claim 1, wherein baffles are made of a composite plastic material.

15. A method of making a shotgun silencer for a shotgun projectile having a compliant shot cup, the silencer including a cylindrical body, comprising the steps of:

providing a plurality of identically formed baffles each supporting a metal guide bushing and having a cylindrical portion with opposite annular surfaces, each metal guide bushing having a diameter substantially the same as the inside diameter of a shotgun barrel to which the silencer is adapted to be attached; and inserting at least three of the baffles into the body in end-to-end relation such that the annular surfaces of the cylindrical portions bear against one another and the guide bushings of at least two adjacent baffles are spaced apart less than the length of the shot cup.

16. The method of making a shotgun silencer as defined in claim 15, including the steps of providing an end closure for the body and sealing the end closure to the body after inserting the baffles into the body.

17. The method of making a shotgun silencer as defined in claim 15, wherein the guide bushings of three baffles are spaced apart less than the length of the shot cup.

* * * * *